US010918191B2

(12) United States Patent
Kang

(10) Patent No.: US 10,918,191 B2
(45) Date of Patent: Feb. 16, 2021

(54) RECEPTACLE FOR MIXING DIFFERENT KINDS OF MATERIALS

(71) Applicant: Seong Il Kang, Seongnam-si (KR)

(72) Inventor: Seong Il Kang, Seongnam-si (KR)

( * ) Notice: Subject to any disclaimer, the term of this patent is extended or adjusted under 35 U.S.C. 154(b) by 0 days.

(21) Appl. No.: 16/610,639

(22) PCT Filed: May 10, 2018

(86) PCT No.: PCT/KR2018/005334
§ 371 (c)(1),
(2) Date: Nov. 4, 2019

(87) PCT Pub. No.: WO2018/208084
PCT Pub. Date: Nov. 15, 2018

(65) Prior Publication Data

US 2020/0054114 A1 Feb. 20, 2020

(30) Foreign Application Priority Data

May 12, 2017 (KR) ..... 10-2017-0059197

(51) Int. Cl.
*A45D 33/26* (2006.01)
*A45D 40/24* (2006.01)
(Continued)

(52) U.S. Cl.
CPC ..... *A45D 40/24* (2013.01); *A45D 33/26* (2013.01); *A45D 34/06* (2013.01);
(Continued)

(58) Field of Classification Search
CPC ..... A45D 33/00; A45D 33/26; A45D 34/00; A45D 34/06; A45D 40/00; A45D 40/24;
(Continued)

(56) References Cited

U.S. PATENT DOCUMENTS 5,224,627 A * 7/1993 Weag ..... B05B 11/0054 222/135
5,740,947 A * 4/1998 Flaig ..... B05B 11/3084 222/135
(Continued)

FOREIGN PATENT DOCUMENTS

JP 2016-505285 A 2/2016
KR 10-2006-0029269 A 4/2006
(Continued)

*Primary Examiner* — Frederick C Nicolas
(74) *Attorney, Agent, or Firm* — Heedong Chae; Lucem, PC

(57) ABSTRACT

A receptacle for mixing different kinds of materials includes an outer receptacle for holding cosmetic contents; a shoulder member of a cylindrical member with the upper and lower portions opened, which is screw-coupled to an upper opening portion of the outer receptacle; a pump coupling member of a disk-shaped member coupled to the inner circumference of the shoulder member, which couples a first pump set and a second pump set side by side; an inner receptacle of a cylindrical member, an upper flange of which is placed between a lower surface of the pump coupling member and an upper surface of the upper opening portion of the outer receptacle, which is partitioned into a first and a second space portions, into which a first and a second pump sets are inserted from the upper part, respectively.

1 Claim, 8 Drawing Sheets

(51) Int. Cl.

| | |
|---|---|
| ***A45D 34/06*** | (2006.01) |
| ***B05B 11/00*** | (2006.01) |
| ***B65D 83/00*** | (2006.01) |
| ***B65D 81/32*** | (2006.01) |
| ***B01F 15/00*** | (2006.01) |
| ***B01F 15/02*** | (2006.01) |
| *A45D 40/00* | (2006.01) |
| *A45D 34/04* | (2006.01) |
| *B05B 15/30* | (2018.01) |
| *A45D 40/26* | (2006.01) |
| *A45D 34/00* | (2006.01) |
| *A45D 33/00* | (2006.01) |

(52) U.S. Cl.
CPC ..... *B01F 15/0087* (2013.01); *B01F 15/0283* (2013.01); *B05B 11/3001* (2013.01); *B05B 11/3084* (2013.01); *B65D 81/3283* (2013.01); *B65D 83/0005* (2013.01); *A45D 34/04* (2013.01); *A45D 40/26* (2013.01); *A45D 2033/001* (2013.01); *A45D 2034/002* (2013.01); *A45D 2040/0006* (2013.01); *A45D 2200/056* (2013.01); *A45D 2200/058* (2013.01); *B01F 2215/0031* (2013.01); *B05B 11/0083* (2013.01); *B05B 11/00416* (2018.08); *B05B 11/3023* (2013.01); *B05B 11/3074* (2013.01); *B05B 15/30* (2018.02)

(58) Field of Classification Search
CPC ..... A45D 2200/056; A45D 2200/058; A45D 40/26; A45D 34/04; A45D 2040/0006; A45D 2033/001; A45D 2034/002; B05B 11/00; B05B 11/3001; B05B 11/3084; B05B 15/30; B05B 11/0083; B05B 11/3023; B05B 11/00416; B05B 11/3074; B65D 81/3283; B65D 81/32; B65D 83/0005; B01F 15/0283; B01F 15/0087; B01F 2215/0031
See application file for complete search history.

(56) References Cited

U.S. PATENT DOCUMENTS

| | | | | |
|---|---|---|---|---|
| 5,833,121 | A * | 11/1998 | Gueret | B05B 11/0029 222/144.5 |
| 6,341,717 | B2 * | 1/2002 | Auer | B05B 11/3029 222/135 |
| 6,672,483 | B1 * | 1/2004 | Roy | B05B 11/0038 222/145.1 |
| 7,063,235 | B2 * | 6/2006 | Auer | B05B 11/0064 222/135 |
| 7,497,354 | B2 * | 3/2009 | Decottignies | B05B 11/3084 222/135 |
| 10,150,126 | B2 * | 12/2018 | Lee | B05B 11/3084 |
| 10,307,779 | B2 * | 6/2019 | Scott | B05B 11/3084 |
| 2019/0357656 | A1 * | 11/2019 | Kang | A45D 33/02 |
| 2019/0366370 | A1 * | 12/2019 | Kang | A45D 34/06 |

FOREIGN PATENT DOCUMENTS

| | | | |
|---|---|---|---|
| KR | 20-0439161 | Y1 | 3/2008 |
| KR | 20-2008-0002044 | U | 6/2008 |
| KR | 10-2014-0122386 | A | 10/2014 |

* cited by examiner

RECEPTACLE FOR MIXING DIFFERENT KINDS OF MATERIALS

TECHNICAL FIELD

The present invention relates to a receptacle for mixing different kinds of materials, and more particularly, to a receptacle for mixing different kinds of materials, wherein an inner receptacle is inserted into an outer receptacle, one of pump sets is mounted in the inner receptacle, and the cosmetic contents different from each other are stored in the inner receptacle and the outer receptacle, while allowing different kinds of cosmetic contents to be used at the same time with one pumping, and to be completely exhausted.

BACKGROUND ART

If two kinds of materials having different ingredients (cosmetics, etc.) are mixed in advance, a problem may occur that these materials deteriorate due to chemical reaction in the mixed state or the performance is remarkably degraded. If the user prepares two containers to store the materials separately and then mixes to use the materials, a problem that causes inconvenience in use occurs.

To solve these problems, a receptacle for mixing different kinds of materials having a structure capable of mixing two kinds of materials by the operation of the user after separately storing two materials in one receptacle is devised and used.

FIGS. 5 and 6 are cross-sectional views of a conventional container for mixing different kinds of materials.

The conventional container for mixing different kinds of materials, as shown in these drawings, includes: a container body portion 111, in which a container storage space 111*a* is formed and a container opening 111*b* is formed at an upper end thereof, a shoulder portion 113 coupled to an upper end of the container body portion 111; an inner cap 112 formed integrally with the shoulder portion 113; a container cap 118 coupled to the shoulder portion 113; a push button 114 disposed on the upper side of the inner cap 112; a pressure tube 119 coupled to the bottom surface of the push button 114; a cylinder 150 installed to be communicated with the container storage space 111*a*; a pumping portion 140 interposed between the cylinder 150 and the push button 114; and an auxiliary storage space portion 160 provided with an auxiliary storage space body portion 161 coupled to the cylinder 150.

The inner cap 112 is formed with a cap hole 112*a* in a central region thereof.

The inner cap 112 having such a configuration is coupled to the shoulder portion 113 so that the cap hole 112*a* communicates with the container storage space 111*a*.

The push button 114 is formed with a "¬"-shaped button flow path 114*a* which connects the bottom surface and the side surface. The push button 114 can move along the height direction of the container body portion 111.

The pressure tube 119 is formed to be communicated with the button flow path 114*a* and the cap hole 112*a*.

The cylinder 150 is formed with a narrowed portion 151 on a bottom region thereof.

The narrowed portion 151 is formed with a through hole 151*a* on the bottom surface thereof and a cylinder engaging shoulder 151*b* is formed on the inner surface thereof. The pumping portion 140 includes: a ring-shaped pumping piston 141 installed inside the cylinder 150; an operating shaft 145 installed to enter into the pressure tube 119 through the pumping piston 141; an operating rod 146 installed inside the operating shaft 145; an opening and closing recessed groove portion 147 formed on the lower end of the operating rod 146; a straw support tube 148 installed so that the upper end thereof reaches the bottom surface of the opening and closing recessed groove portion 147 and the lower end thereof passes through the through hole 151*a* to be exposed to the outside of the cylinder 150; a straw 149 installed inside the straw support tube 148; and a return spring 144 installed to support both ends thereof by the push button 114 and the inner cap 112.

The pumping piston 141 is installed in close contact with the inner surface of the cylinder 150 such that an intermediate storage chamber 150*a* is formed between the bottom surfaces of the cylinder 150.

In addition, the pumping piston 141 is installed inside the cylinder 150 to be spaced apart from the lower end of the pressure tube 119.

Accordingly, when the pressure tube 119 is descended by pressing the push button 114, the pumping piston 141 descends by itself as much as a distance that the pressure tube 119 is spaced apart from the pumping piston 141, and then can be descended together with the pressure tube 119.

The operating shaft 145 includes a linear operating shaft body portion 145*b* and a stem 145*c* formed at the lower end of the operating shaft body portion 145*b*.

The inner space of the operating shaft body portion 145*b* becomes the operating shaft flow path 145*a*.

When ascending, the stem 145*c* presses the pumping piston 141 upward.

The operating shaft 145 having such a configuration is installed such that the stem 145*c* passes through the pumping piston 141 and the operating shaft body portion 145*b* is coupled to the pressure tube 119. In this way, the operating shaft 145 can ascend and descend together with the pressure tube 119.

The opening and closing recessed groove portion 147 is formed with a plurality of opening and closing recessed groove flow path forming protrusions 147*a* protruding along the longitudinal direction on the upper side of the outer surface thereof.

The opening and closing recessed groove flow path forming protrusions 147*a* are spaced apart from each other, and thus the opening and closing recessed groove flow path is formed in a space between the opening and closing recessed groove flow path forming protrusions 147*a*.

The straw support tube 148 is formed with a plurality of support tube flow path forming protrusions 148*a* protruding along the longitudinal direction on the upper side of the outer surface thereof.

The support tube flow path forming protrusions 148*a* are spaced apart from each other, and thus a support tube flow path is formed in a space between the support tube flow path forming protrusions 148*a*. A return spring 144 is installed such that both ends thereof are supported by the push button 114 and the inner cap 112.

The auxiliary storage space portion 160 is provided with an auxiliary storage space sealing plate portion 162 formed at the lower end of the straw support tube 148 in addition to the auxiliary storage space body portion 161.

The auxiliary storage space sealing plate portion 162 is formed to be disposed perpendicularly to the longitudinal direction of the straw support tube 148.

The auxiliary storage space body portion 161 has a structure capable of forming a sealed space in cooperation with the straw supporting tube 148, the auxiliary storage space sealing plate portion 162, and the cylinder 150.

The operation of conventional containers for mixing different kinds of materials having such a structure will be described with reference to FIGS. 7 and 8. For convenience of explanation, it is assumed that the liquid cosmetics are stored in the inner space of the container body portion 111, that is, in the container storage space 111*a*, and the powdered cosmetics are stored in the auxiliary storage space portion 160.

When first pressing the push button 114 downward, the pressure tube 119 descends by itself as much as a distance spaced apart from the pumping piston 141, and then the pressure tube 119 descends together with the pumping piston 141. When pressing the push button 114, elastic force is accumulated in the return spring 144.

When the pressure tube 119 descends, the opening and closing recessed groove portion 147 and the straw support tube 148 descend as well. Here, the opening and closing recessed groove portion 147 is descended such that the opening and closing recessed groove flow path forming protrusions 147*a* cross the cylinder engaging shoulder 151*b*.

When the straw support tube 148 descends, the auxiliary storage space sealing plate portion 162 also descends to cross the lower end of the auxiliary storage space body portion 161.

When the auxiliary storage space sealing plate portion 162 descends, powder cosmetics stored in the auxiliary storage space portion 160 and liquid cosmetics stored in the container storage space 111*a* are mixed (see FIG. 7).

Next, when releasing the pressure applied to the push button 114, the push button 114 ascends to the original position by elastic force accumulated in the return spring 144. When the push button 114 ascends, the operating shaft 145 and the pumping piston 141 ascend and the operating shaft flow path 145*a* is closed by the pumping piston 141.

In addition, when the operating shaft 145 ascends, the operating rod 146 and the opening and closing recessed groove portion 147 also ascend. Here, the ascending distance of the operating rod 146 and the opening and closing recessed groove portion 147 is limited by the engagement action between the opening and closing recessed groove flow path forming protrusions 147*a* and the cylinder engaging shoulder 151*b*.

When the operating rod 146 and the opening and closing recessed groove portion 147 ascend, the groove bottom surface of the opening and closing recessed groove portion 147 and the upper end of a straw 149 are spaced apart from each other, and thus the container storage space 111*a* is connected to the intermediate storage chamber 150*a* through the straw 149, the opening and closing recessed groove flow path which is formed in a space between the opening and closing recessed groove flow path forming protrusion 147*a*, and the support tube flow path which is formed in a space between the support tube flow path forming protrusions 148*a*.

As such, the operating shaft 145 ascends in the state in which the container storage space 111*a* is connected to the intermediate storage chamber 150*a*, so that a negative pressure is generated in the intermediate storage chamber 150*a* and the mixed cosmetics in the container storage space 111*a* flow into the intermediate storage chamber 150*a* through the support tube flow path (see FIG. 8).

Next, when pressing the push button 114 downward, the pressure tube 119 descends by itself as much as a distance spaced apart from the pumping piston 141, and then the pressure tube 119 descends together with the pumping piston 141.

During the pressure tube 119 descends as much as a distance spaced apart from the pumping piston 141, the operating shaft flow path 145*a* is communicated with the intermediate storage chamber 150*a*.

When the operating shaft flow path 145*a* is communicated with the intermediate storage chamber 150*a*, the mixed cosmetics in the intermediate storage chamber 150*a* pass through the operating shaft flow path 145*a*, the pressure tube 119, and the button flow path 114*a* sequentially to be discharged to the outside.

On the other hand, when the push button 114 descends, elastic force is accumulated in the return spring 144.

Next, when releasing the pressing force to the push button 114, the push button 114 ascends to the original position by elastic force accumulated in the return spring 144.

When the push button 114 ascends, the operating shaft 145 and the pumping piston 141 ascend and the operating shaft flow path 145*a* is closed by the pumping piston 141.

When the operating shaft 145 ascends, a negative pressure is generated in the intermediate storage chamber 150*a*, and the mixed cosmetics in the container storage space 111*a* flow into the intermediate storage chamber 150*a*.

A conventional container for mixing different kinds of materials having the above-described configuration is disclosed in a Utility Model Application No. 2002-15583 (Title of Utility Model: MIXED COSMETIC CONTAINER).

However, according to the conventional container for mixing different kinds of materials, since different kinds of materials are mixed by a method of descending the auxiliary storage space sealing plate portion 162 though the operating rod 146, the opening and closing recessed groove portion 147, and the straw support tube 148, which are installed in the cylinder 150, there was a problem that the structure for mixing different kinds of materials is complicated and the product assembly is difficult.

Since the operating rod 146, the opening and closing recessed groove portion 147, and the straw support tube 148 are disposed inside the cylinder 150, there was a problem that the size of the intermediate storage chamber 150*a* is reduced due to the structure for mixing different kinds of materials.

DISCLOSURE

Technical Problem

The present invention is invented to meet the needs of the conventional art, and it is an object of the present invention to provide a receptacle for mixing different kinds of materials, wherein an inner receptacle is inserted into an outer receptacle, one of pump sets is mounted in the inner receptacle and the outer receptacle, respectively, and cosmetic contents different from each other are stored in the inner receptacle and the outer receptacle, while allowing different kinds of cosmetic contents to be used at the same time with one pumping, to be mixed with different pumping amounts, and to be completely exhausted.

Technical Solution

A receptacle for mixing different kinds of materials according to a first embodiment of the present invention, includes: an outer receptacle (10) for holding cosmetic contents; a shoulder member (20) of a cylindrical member having open upper and lower portions, which is screw-coupled to an upper opening portion (11) of the outer receptacle (10); a pump coupling member (50) of a disk-shaped member coupled to the inner circumference of the shoulder member (20), which couples a first pump set (30) and a second pump set (40) side by side; an inner receptacle (60) of a cylindrical member, an upper flange (61) of which is placed between a lower surface of the pump coupling member (50) and an upper surface of the upper opening portion (11) of the outer receptacle (10), which is partitioned into a first and a second space portions (62, 63), into which a first and a second pump sets (30, 40) are inserted from the upper part, respectively, in which the lower part of the first space part (62) is opened and the lower part of the second space part (63) is closed; a button member (70) of a cylindrical member, of which the upper part inserted into the upper opening portion of the shoulder member (20) is closed and the lower part thereof is opened, which is coupled to discharge the cosmetic contents to the outside by pressing to operate the first and the second pump sets (30, 40) while receiving them in the lower part; a cover member (80) coupled to the upper outer circumference of the shoulder member (20) to cover the button member at the upper part of the button member (70); and an internal piston for the inner receptacle (90) which is a member inserted into the lower part of the inner receptacle (60), which lifts up the cosmetic contents in the inner receptacle (60) to be completely exhausted when the pump is pumped by the first and second pump sets (30, 40).

Advantageous Effects

According to a receptacle for mixing different kinds of materials of the present invention, the second pump set is configured by inserting a cylindrical cylinder member into the inner circumference of the second pump housing so that a smaller amount of cosmetic contents are pumped than the cosmetic contents pumped by the first pump set. That is, since the pumping amounts of the cosmetic contents in the inner receptacle is less than the pumping amounts of the cosmetic contents in the outer receptacle, it is useful when the dilution ratio between the cosmetic contents in the outer receptacle and the cosmetic contents in the inner receptacle is 2:1 or 3:1, that is, when the pumping amounts of the first and the second pump sets are different.

In addition, the cosmetic contents in the inner receptacle 60 are completely pumped by the first and the second pump sets 30, 40 and thus are exhausted as the internal piston for the inner receptacle 90 ascends, thereby not wasting the cosmetic contents.

BEST MODE

Figure 1:
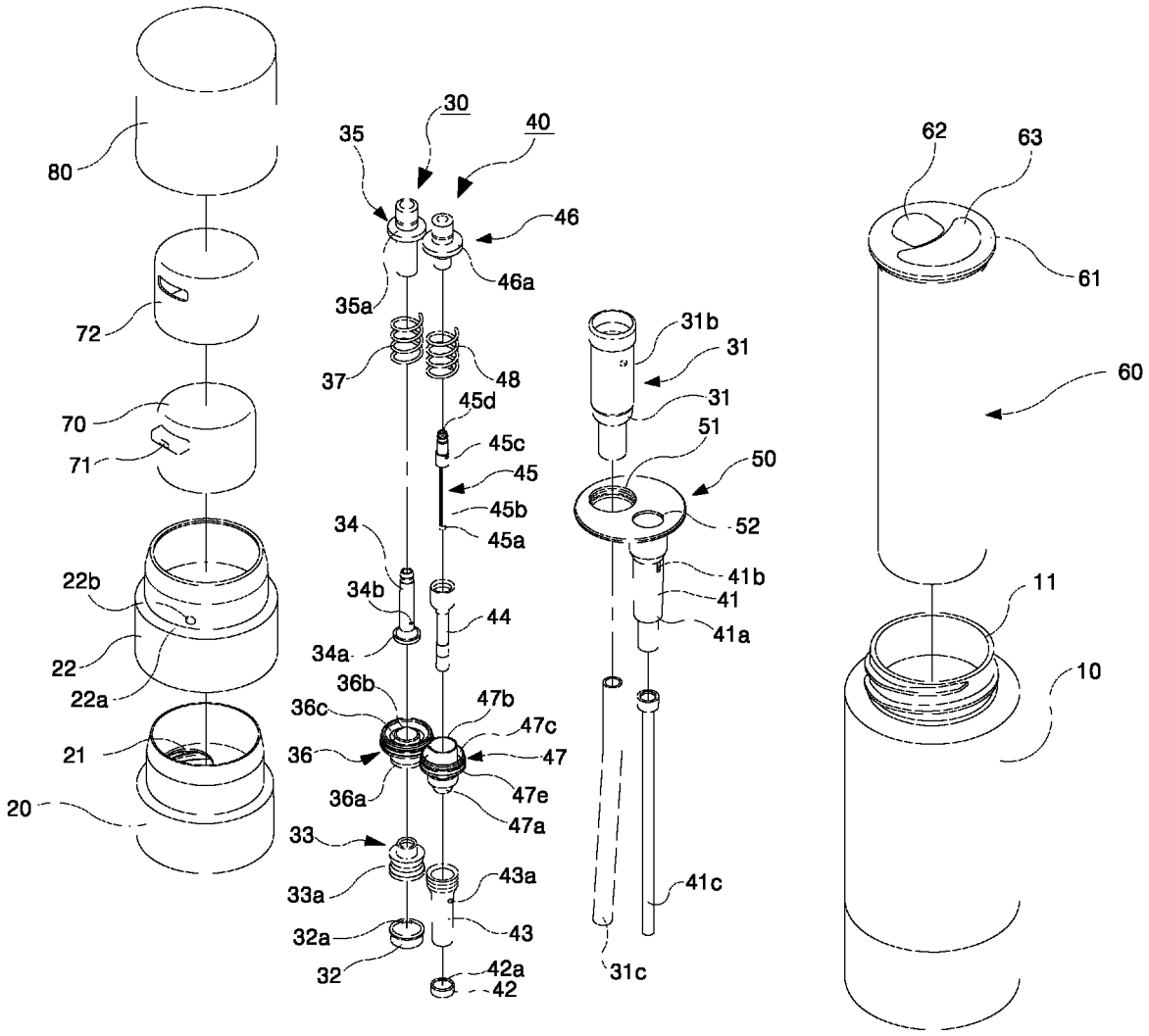
FIG. 1 is an exploded perspective view showing a pump of a receptacle for mixing different kinds of materials according to a first embodiment of the present invention.

Hereinafter, the preferred embodiments of the present invention will be described in detail with reference to the accompanying drawings so that those skilled in the art can easily carry out the present invention. It should be noted that reference numerals used to denote the configuration in the accompanying drawings are used to denote the same configuration even in other drawings as much as possible. Further, in the description of the present invention, a detailed description of known functions and configurations incorporated herein will be omitted when it may make the subject matter of the present invention rather unclear. In addition, certain features shown in the drawings are enlarged, reduced, or simplified for ease of description, and the drawings and their components are not necessarily illustrated at an appropriate rate. However, these details will be easily understood by those skilled in the art.

The terms including ordinals such as "first," "second," etc. may be used herein to describe various components, but these components are not limited to the terms. These terms are used only to distinguish one component from another component. For example, the first component may be referred to as a second component without departing from the scope of the claims of the present invention, and similarly, the second component may also be referred to as a first component. The term "and/or" includes any combination of a plurality of related listed items or any of a plurality of related listed items.

In addition, related terms described on the basis of what is shown in the drawings such as "front," "rear," "top," "below," and the like may be replaced with ordinals such as "first," "second," and the like.

The ordinal numbers such as "first," "second," and the like are arbitrarily set in the order described, and thus the order may be arbitrarily changed as necessary.

The terminology used herein is for the purpose of describing particular embodiments only and is not intended to be limiting of the invention. The singular forms comprise plural referents unless the context clearly dictates otherwise. It is to be understood that the terms such as "comprise" or "have" as described in the present specification, are intended to designate the presence of stated features, numbers, steps, operations, components, parts or combinations thereof, but not to preclude the possibility of the presence or addition of one or more other features, numbers, steps, operations, components, parts, or combinations thereof.

Unless otherwise defined, all terms including technical and scientific terms used herein have the same meaning as commonly understood by those skilled in the art to which the present invention pertains. The terms defined in commonly used dictionaries should be interpreted as having a meaning that is consistent with their meaning in the context of the relevant arts, and will not be interpreted in an idealized or overly formal meaning unless expressly so defined herein.

Hereinafter, the preferred embodiments of the present invention will be described in detail with reference to the accompanying drawings. Further, in the description of the present invention, a detailed description of known functions and configurations incorporated herein will be omitted when it may make the subject matter of the present invention rather unclear.

First Embodiment

Figure 2:
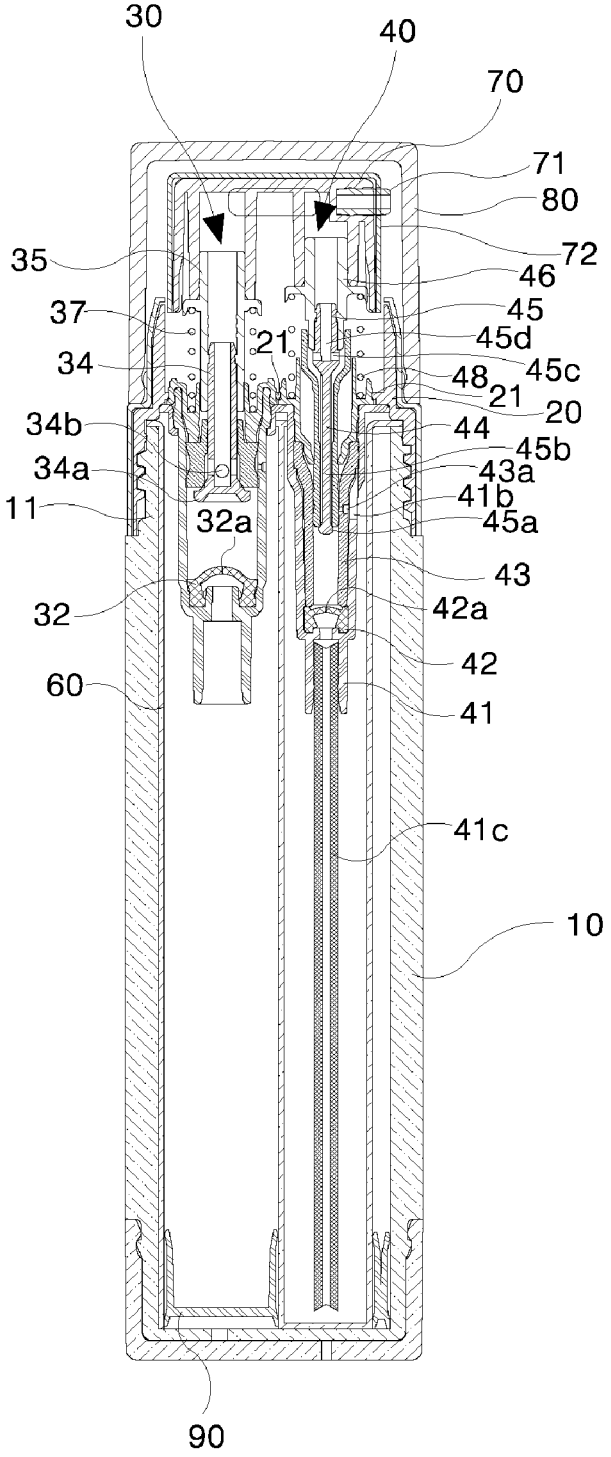
FIG. 2 is an assembly cross-sectional view showing a receptacle for mixing different kinds of materials according to a first embodiment of the present invention.
Figure 3:
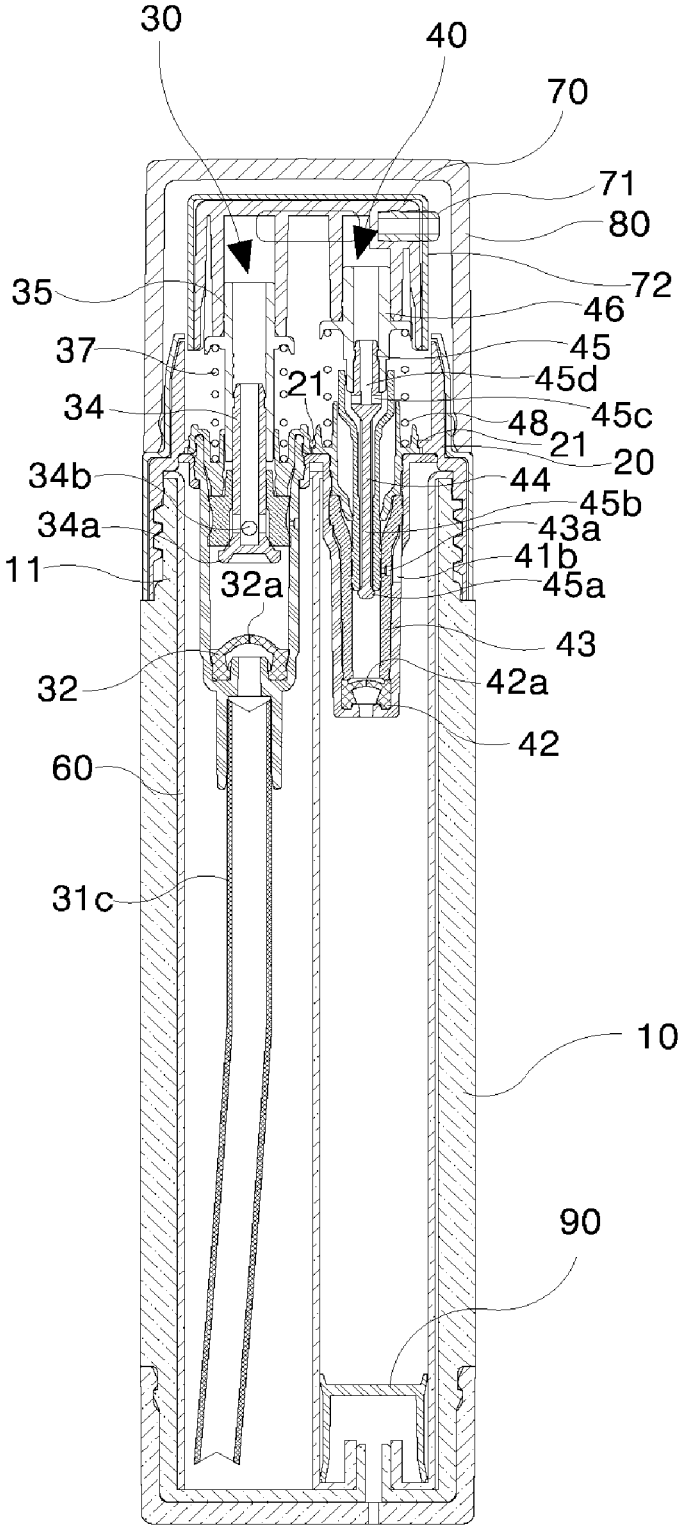
FIG. 3 is an assembly cross-sectional view showing a receptacle for mixing different kinds of materials according to a second embodiment of the present invention.
Figure 4:
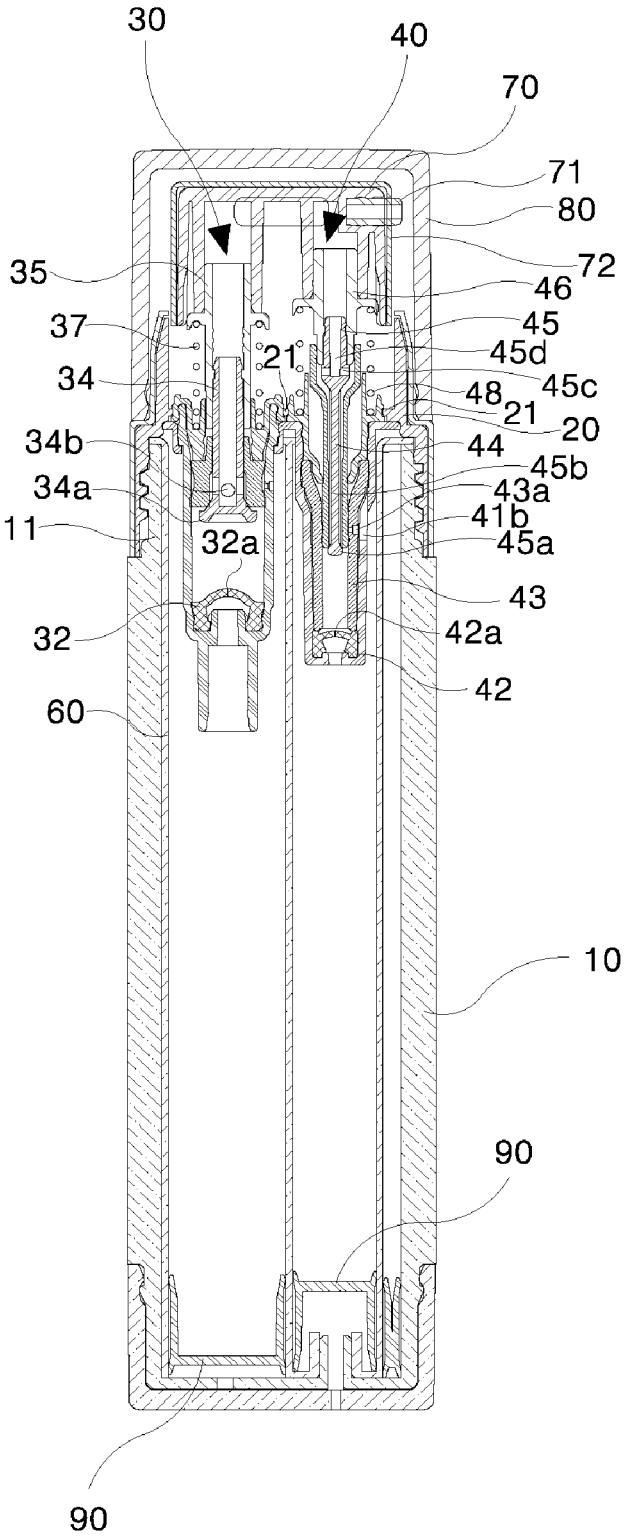
FIG. 4 is an assembly cross-sectional view showing a receptacle for mixing different kinds of materials according to a second embodiment of the present invention.
Figure 5:
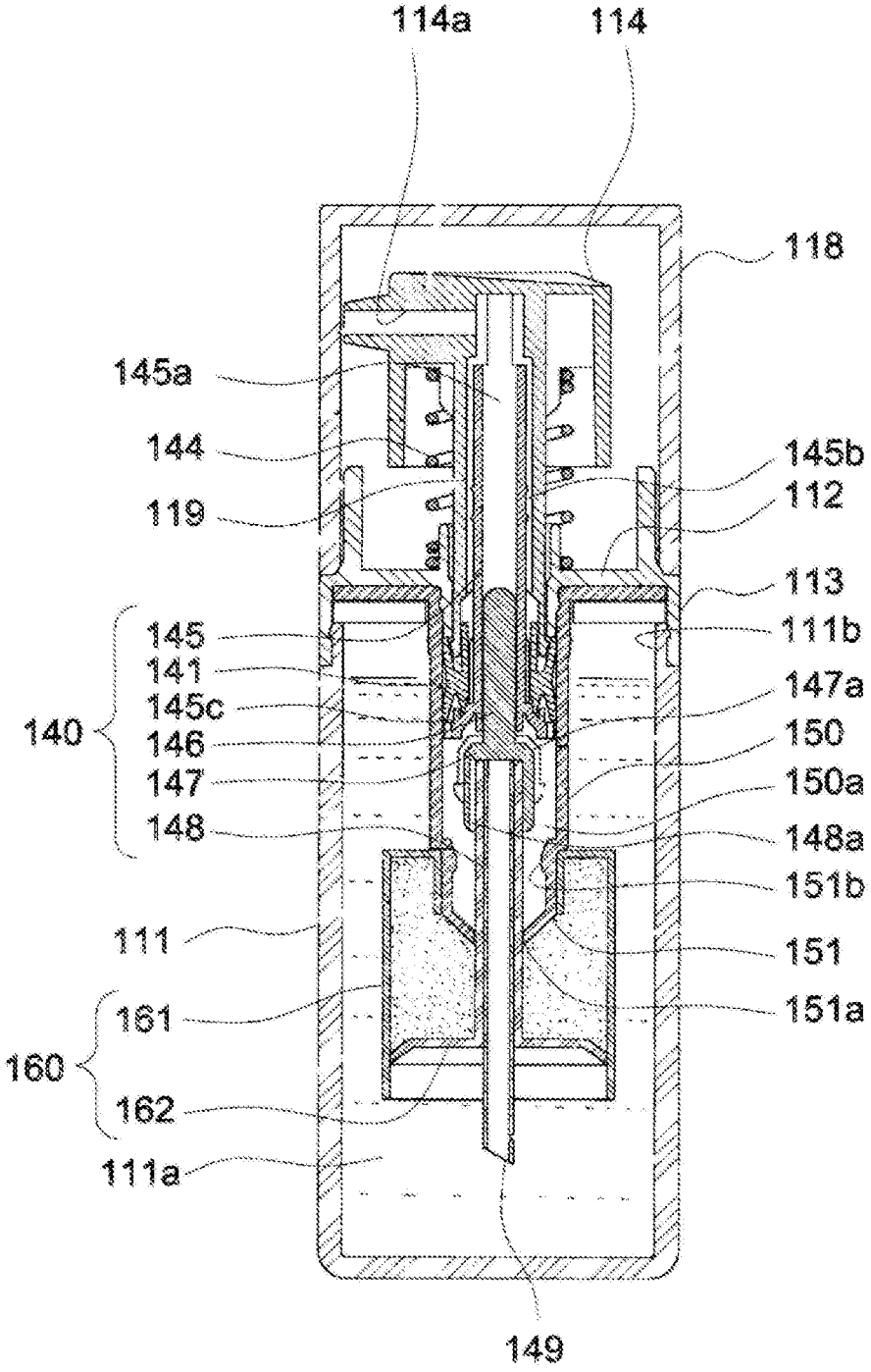
FIG. 5 PRIOR ART
FIGS. 5 and 6 are cross-sectional views of a conventional container for mixing different kinds of materials.
Figure 6:
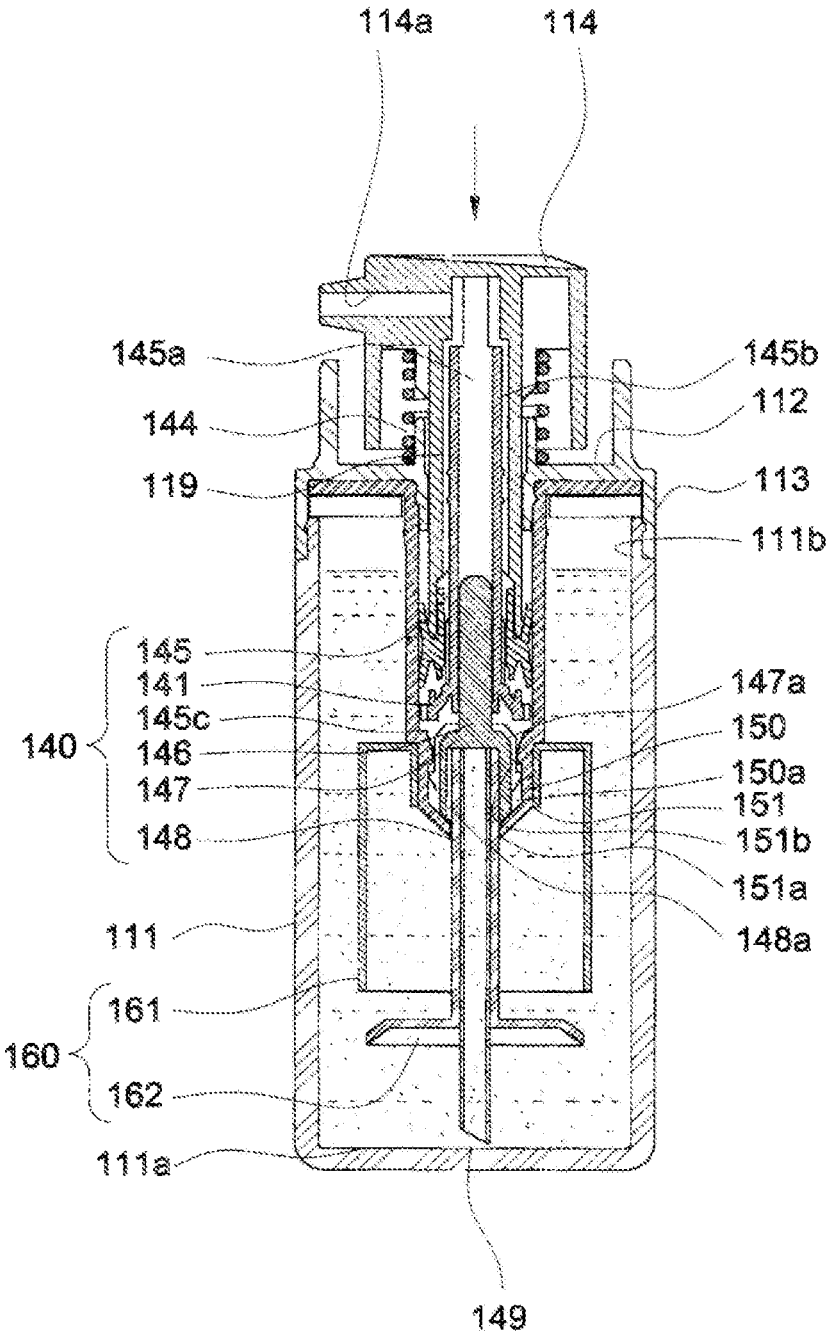
FIG. 6 PRIOR ART
Figure 7:
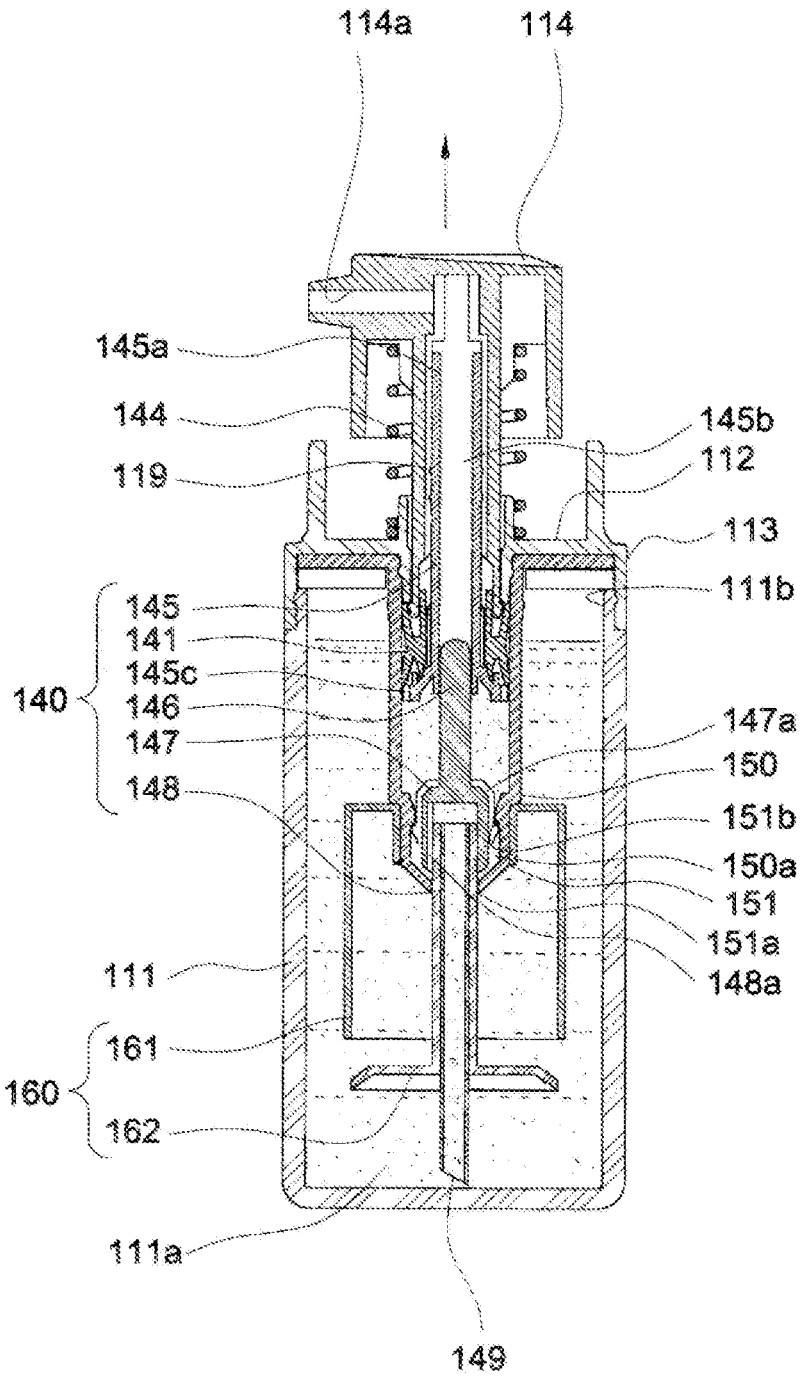
FIG. 7 PRIOR ART
FIGS. 7 and 8 are views showing a method of using a conventional receptacle for mixing different kinds of materials, respectively.
Figure 8:
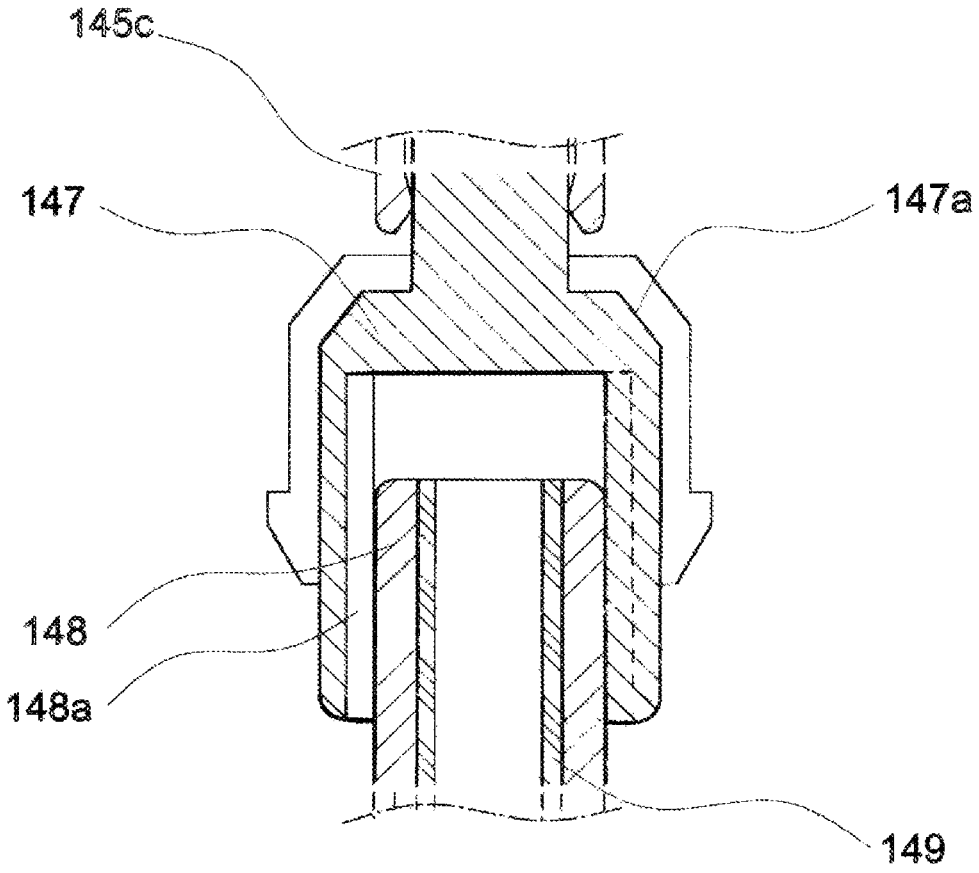
FIG. 8 PRIOR ART

FIG. 1 is an exploded perspective view showing a pump of a receptacle for mixing different kinds of materials according to a first embodiment of the present invention. FIG. 2 is an assembly cross-sectional view showing a receptacle for mixing different kinds of materials according to a first embodiment of the present invention, FIG. 3 is an assembly cross-sectional view showing a receptacle for mixing different kinds of materials according to a second embodiment of the present invention, and FIG. 4 is an assembly cross-sectional view showing a receptacle for mixing different kinds of materials according to a second embodiment of the present invention.

As shown in FIGS. 1 to 4, the receptacle for mixing different kinds of materials according to the present invention includes: an outer receptacle 10 for holding cosmetic contents; a shoulder member 20 of a cylindrical member having open upper and lower portions, which is screw-coupled to an upper opening portion 11 of the outer receptacle 10; a pump coupling member 50 of a disk-shaped member coupled to the inner circumference of the shoulder member 20, which couples a first pump set 30 and a second pump set 40 side by side; an inner receptacle 60 of a cylindrical member, an upper flange 61 of which is placed between a lower surface of the pump coupling member 50 and an upper surface of the upper opening portion 11 of the outer receptacle 10, which is partitioned into a first and a second space portions 62, 63, into which a first and a second pump sets 30, 40 are inserted from the upper part, respectively, in which the lower part of the first space part 62 is opened and the lower part of the second space part 63 is closed; a button member 70 of a cylindrical member, of which the upper part inserted into the upper opening portion of the shoulder member 20 is closed and the lower part thereof is opened, which is coupled to discharge the cosmetic contents to the outside by pressing to operate the first and the second pump sets 30, 40 while receiving them in the lower part; a cover member 80 coupled to the upper outer circumference of the shoulder member 20 to cover the button member at the upper part of the button member 70; and an internal piston for the inner receptacle 90 which is a member inserted into the lower part of the inner receptacle 60, which lifts up the cosmetic contents in the inner receptacle 60 to be completely exhausted when the pump is pumped by the first and second pump sets 30, 40.

The pump coupling member 50 includes a seating hole 51 formed at an upper side thereof, in which the first pump set 30 is safely seated to be coupled, and a coupling hole 52 formed on the other side of the upper part so that the cylindrical second pump housing 41 of the second pump set 40 is coupled to the lower part of the pump coupling member.

The first pump set 30 includes: a cylindrical first pump housing 31 of a cylindrical member with the upper and lower portions opened, which are safely seated in the seating hole 51 of the pump coupling member 50 from the upper part, and has a stepped portion 31*a* whose lower part has a smaller inner diameter; a first check valve 32 of a cylindrical member seated on an upper surface of the stepped portion 31*a*, wherein a slit 32*a* is formed in the center of the closed upper surface and the lower part has an open shape; a first piston 33 of a cylindrical member with the upper and lower portions opened, which is in close contact the inner circumference of the first pump housing 31 and moves vertically, wherein a groove 33*a* concave in the center of the outer circumference is formed; a first piston rod 34 of a cylindrical member with an upper part opened, which is fitted in the center of the first piston 33 from the lower part, on the lower end of which a cylindrical protrusion 34*a* to open and close the lower hole of the first piston 33 while raising the first piston 33 protrudes in the circumferential direction, and on the upper circumference of the cylindrical protrusion 34*a*, a plurality of horizontal holes 34*a* penetrating toward the center portion from the outer circumference are formed; a first push member 35 of a cylindrical member having the penetrating upper and lower parts, which is coupled to an upper outer circumference of the first piston rod 34, on the center of which a disk-shaped wing 35*a* protrudes in a cylindrical shape, and on an upper side of the disk-shaped wing 35*a* of which the button member 70 is fitted to be communicated with a discharge hole; a first coupling member 36 in a cylindrical shape, which is seated in the upper hole of the first pump housing 31 to press the upper surface of the first piston 33, wherein the upper side of the seating hole 51 is put on the outer circumferential horizontal surface of the seating hole 51, and thus the circumference thereof is coupled to the inner coupling hole 21; and a first cylindrical spring 37, wherein the lower part thereof is inserted into the cylindrical groove 36*c* of the first coupling member 36 in a cylindrical shape, and the upper part thereof is pressed on the lower surface of the disk-shaped wing 35*a* of the first push member 35.

The first coupling member 36 in a cylindrical shape includes: a lower pressing portion 36*a* seated in the upper hole of the first pump housing 31 to press the upper surface of the first piston 33; a tubular portion 36*b* formed vertically from the lower pressing portion 36*a* upward to guide the outer circumference of the first push member 35; a protruding wall 36*d* protruding vertically to form a circumferential groove 36*c* at the outer circumference of the tubular portion 36*b*; and a coupling groove 36*e* formed to be coupled to the inner coupling hole 21 of the shoulder member 20 at the outer circumference of the protruding wall 36*d*.

The second pump set 40 includes: a cylindrical second pump housing 41 of a cylindrical member with the upper and lower portions opened, which is coupled to the lower part of the coupling hole 52 of the pump coupling member 50, and has a stepped portion 41*a* whose lower part has a smaller inner diameter; a second check valve 42 of a cylindrical member seated on an upper surface of the stepped portion 41*a*, wherein a slit 42*a* is formed in the center of the closed upper surface and the lower part has an open shape; a cylinder member 43 in a cylindrical shape with the upper and lower parts opened, which is the upper part of the second check valve 42 and is in close contact the inner circumference of the second pump housing 41; a cylindrical second piston 44, the upper and lower parts of which are opened, which is inserted into the inner circumference of the cylinder member 43 and moves vertically, and the upper part thereof is expanded; a second piston rod 45 of a rod-shaped member inserted into the second piston 44, wherein a ball-shaped opening and closing protrusion 45*a* is formed to open and close the lower hole of the second piston 44 on the lower end thereof, a plurality of vertical protrusions 45*b* are formed at the upper outer circumference of the opening and closing protrusion 45*a*, a plurality of horizontal holes 45*c* penetrating toward the center from the outer circumference is formed in the upper expansion portion 45*e* of the plurality of vertical protrusions 45*b*, and a vertical hole 45*d* communicating from the center of the horizontal hole 45*c* to the upper part is penetrated; a second push member 46 of a cylindrical member having the penetrating upper and lower parts, which is coupled to the outer circumference of the expansion portion 45*e* of the second piston 45, wherein a disk-shaped wing 46*a* protrudes in a cylindrical shape on the center thereof, and a button member 70 is inserted into an upper side of the disk-shaped wing 46*a* thereof to be communicated with a discharge hole 71; a second coupling member 47 in a cylindrical shape, wherein the lower side thereof is seated in the coupling hole 52 of the pump coupling member 50 to press the upper surface of the cylinder member 43, the upper side thereof is put on the outer circumferential horizontal surface of the coupling hole 52, and thus the circumference thereof is coupled to the inner coupling hole 21; and a second spring 48 in a cylindrical shape, wherein the lower part thereof is inserted into the cylindrical groove 47*c* of the second coupling member 47 in a cylindrical shape, and the upper part thereof is pressed on the lower surface of the disk-shaped wing 46*a* of the second push member 46.

The second coupling member 47 in a cylindrical shape includes: a lower pressing portion 47*a* having a shape in which the inner diameter becomes narrower toward the lower portion, which is seated in the coupling hole 52 to press the upper surface of the cylinder member 43 and at the same time contact the outer circumference of the second piston 44; a receiving pipe portion 47*b* which is formed vertically upward from the lower pressing portion 47*a* to accommodate the upper expanding portion of the second piston 44; a protruding wall 47*d* protruding vertically to form a cylindrical groove 47*c* at the outer circumference of the receiving pipe portion 47*b*; and a coupling groove 47*e* formed to be coupled to the inner coupling hole 21 of the shoulder member 20 at the outer circumference of the protruding wall 47*d*.

Inlet holes 31*b*, 41*b* through which external air flows are formed at upper side surfaces of the first and the second pump housings 31, 41, respectively.

An air hole 43*a* is formed at an upper outer circumference of the cylinder member 43 in a cylindrical shape to be communicated with an inflow hole 41*b* of the second pump housing 41 so that air is introduced into the cylinder.

A shoulder cover member 22 is formed on the upper part of the shoulder member 20 in the same manner as the outer shape of the shoulder member 20 to cover it. In addition, a button cover member 72 is formed even on the upper part of the button member 70 in the same manner as the outer shape of the button member 70 to cover it.

On the upper part of the button cover member 72, a receptacle cover member 80 of a cylindrical member with the lower part opened is installed, the bottom surface of which is supported on the flange 22*a* of the shoulder cover member 22 and coupled to a coupling protrusion 22*b* formed on the outer circumference of the shoulder cover member 22 to cover the shoulder cover member 22.

The lower parts of the stepped portions 31*a*, 41*a* of the first and the second pump housings 31, 41 are connected with hoses 31*c*, 41*c* for sucking the cosmetic contents, respectively.

The receptacle for mixing different kinds of materials according to a first embodiment of the present invention configured as described above includes two pump sets, that is, the first pump set 30 is configured to pump the cosmetic contents in the outer receptacle 10 and the second pump set 40 is configured to pump the cosmetic contents in the inner receptacle 10 so that different kinds of cosmetic contents can be mixed and used simultaneously with one pumping.

In addition, the second pump set 40 is configured by inserting a cylindrical cylinder member 43 into the inner circumference of the second pump housing 41, so that the cosmetic contents are pumped less than the cosmetic contents pumped by the first pump set 30. That is, the pumping amount of the cosmetic contents in the inner container 60 is less than the pumping amount of the cosmetic contents in the outer receptacle 10.

For example, when the dilution ratio of the cosmetic contents in the outer receptacle 10 and the cosmetic contents in the inner receptacle 60 is 2:1 or 3:1, that is, it is useful when the pumping amount of the first and the second pump sets 30, 40 is different.

In addition, as the cosmetic contents are exhausted, the inner piston for the inner receptacle 90 inserted in the lower part of the inner receptacle 60 ascends and exhausts the cosmetic contents to the upper part.

As FIG. 2 is a type in which a hose 41*c* for inhaling the cosmetic contents is connected only to the lower part of the stepped portion 41*a* of the second pump housing 41, the inner piston for the inner receptacle 90 is inserted only in the first space portion 62 of the inner receptacle 90.

As FIG. 3 is a type in which a hose 31*c* for inhaling the cosmetic contents is connected only to the lower part of the stepped portion 31*a* of the second pump housing 41, the inner piston for the inner receptacle 90 is inserted only in the second space portion 63 of the inner receptacle 90.

As FIG. 4 is a type in which hoses 31*c*, 41*c* are not connected to the lower part of the stepped portions 31*a*, 41*a* of the first and second pump housings 31, 41, the inner piston for the inner receptacle 90 is inserted in the first and the second space portions 62, 63 of the inner receptacle 90, respectively.

As the cosmetic contents in the inner receptacle 60 are pumped by the first and the second pump sets 30, 40, and thus the inner piston for the inner receptacle 90 ascends, the cosmetic contents are completely pumped to be exhausted. By completely exhausting as described above, the cosmetic contents are not wasted.

As described above, while the present invention has been described with reference to exemplary embodiments thereof in the detailed description, it is obvious that the techniques of the present invention are easily modified by those skilled in the art, and these modified embodiments will be included in the technical idea described in the claims of the present invention.

The invention claimed is:

1. A receptacle for mixing materials, comprising:

an outer receptacle (10) for holding cosmetic contents;

a shoulder member (20) of a cylindrical member with upper and lower portions opened, which is screw-coupled to an upper opening portion (11) of the outer receptacle (10);

a pump coupling member (50) of a disk-shaped member coupled to an inner circumference of the shoulder member (20), which couples a first pump set (30) and a second pump set (40) side by side;

an inner receptacle (60) of a cylindrical member, an upper flange (61) of which is placed between a lower surface of the pump coupling member (50) and an upper surface of the upper opening portion (11) of the outer receptacle (10), which is partitioned into a first and a second space portions (62, 63) into which a first and a second pump sets (30, 40) are inserted from an upper part, respectively, in which a lower part of the first space portion (62) is opened and the lower part of the second space portion (63) is closed;

a button member (70) of a cylindrical member, of which the upper part inserted into the upper opening portion of the shoulder member (20) is closed and the lower part thereof is opened, which is coupled to discharge the cosmetic contents to the outside by pressing to operate the first and the second pump sets (30, 40) while receiving the first and the second pump sets (30, 40) in the lower part;

a cover member (80) coupled to an upper outer circumference of the shoulder member (20) to cover the button member at the upper part of the button member (70); and an internal piston (90) for the inner receptacle (60) which is a member inserted into the lower part of the inner receptacle (60), and lifts up the cosmetic contents in the inner receptacle (60) to be completely exhausted when the pump is pumped by the first and second pump sets (30, 40), wherein a cylinder member (43) in a cylindrical shape is inserted into the inner circumference of a second pump housing (41) of the second pump set (40) so that pumping amounts of the cosmetic contents in the outer receptacle (10) pumped by the first pump set (30) and the pumping amounts of the cosmetic contents in the inner receptacle (60) are different.

* * * * *